US006902060B2

(12) United States Patent
Michelson et al.

(10) Patent No.: US 6,902,060 B2
(45) Date of Patent: Jun. 7, 2005

(54) BROOM AND DUSTPAN KIT

(75) Inventors: Robert Michelson, Wayland, MA (US); Thomas Dunn, Leominster, MA (US)

(73) Assignee: Butler Home Products LLC, Holliston, MA (US)

( * ) Notice: Subject to any disclaimer, the term of this patent is extended or adjusted under 35 U.S.C. 154(b) by 121 days.

(21) Appl. No.: 10/340,531

(22) Filed: Jan. 10, 2003

(65) Prior Publication Data

US 2004/0134803 A1 Jul. 15, 2004

(51) Int. Cl.[7] ..... B65D 69/00; A47L 13/52

(52) U.S. Cl. ..... 206/576; 206/223; 15/257.1; 15/257.7

(58) Field of Search ..... 15/257.1, 257.2, 15/257.7, 145

(56) References Cited

U.S. PATENT DOCUMENTS

| | | | | |
|---|---|---|---|---|
| 260,119 A | | 6/1882 | Perry | |
| 577,220 A | * | 2/1897 | Whitehead | 294/19.1 |
| 675,052 A | | 5/1901 | Carlson | |
| 783,657 A | | 2/1905 | Walter | |
| 926,927 A | | 7/1909 | Devol | |
| 1,191,945 A | * | 7/1916 | Carlson | 15/257.7 |
| 1,466,454 A | | 8/1923 | Mock | |
| 1,579,279 A | | 4/1926 | Cave | |
| 2,699,050 A | | 1/1955 | MacKay | |
| 2,849,743 A | | 9/1958 | McFarland | |
| 3,018,502 A | | 1/1962 | Lossius | |
| 3,029,455 A | | 4/1962 | Siculan | |
| 3,407,424 A | * | 10/1968 | Lanzarone et al. | 15/145 |
| 3,600,740 A | * | 8/1971 | Ogier | 15/257.01 |
| 3,639,937 A | | 2/1972 | Sweeney | |
| 3,765,044 A | | 10/1973 | Hanahan et al. | |
| 4,082,186 A | * | 4/1978 | Chirumbolo | 206/577 |
| 4,447,927 A | | 5/1984 | Malless, Jr. | |
| 4,584,735 A | | 4/1986 | Garber | |
| 4,769,869 A | | 9/1988 | Benitez | |
| 5,367,737 A | | 11/1994 | Vosbikian et al. | |
| 5,379,481 A | | 1/1995 | DeMars | |
| 5,412,835 A | | 5/1995 | Vosbikian et al. | |
| 5,425,153 A | | 6/1995 | Vosbikian | |
| 5,661,868 A | | 9/1997 | Panagakos et al. | |
| D386,851 S | | 11/1997 | Levine | |
| 5,715,564 A | | 2/1998 | Knouse | |
| 5,839,145 A | | 11/1998 | Petner | |
| 5,852,843 A | | 12/1998 | Vosbikian | |
| D409,343 S | | 5/1999 | Kingry et al. | |
| 5,953,784 A | | 9/1999 | Suzuki et al. | |

(Continued)

FOREIGN PATENT DOCUMENTS

| | | |
|---|---|---|
| DE | 3813346 A1 | 11/1989 |
| DE | 3840461 A1 | 6/1990 |
| JP | 2001046808 | 8/2002 |

*Primary Examiner*—Randall Chin
(74) *Attorney, Agent, or Firm*—Kriegsman & Kriegsman

(57) ABSTRACT

A kit includes the combination of an stand-up dustpan having a length of approximately 107.5 cm and a less than full-sized broom having a length of approximately 84.8 cm. The floor cleaning kit also includes an enclosed box-shaped container shaped to define an interior cavity into which the dustpan and broom, when they are disassembled, can be disposed, the container having a length of approximately 36.8 cm, a width of approximately 32.6 cm and a depth of approximately 10.9 cm. Each of the dustpan and the broom includes a handle comprising at least two independent sections which are adapted to be coupled together. The container includes a rear panel, a front panel, a pair of side panels, a top panel and a bottom panel which together define the enclosed interior cavity. The container additionally includes a partition which at least partially subdivides the enclosed interior cavity into an upper chamber and a lower chamber.

34 Claims, 7 Drawing Sheets

U.S. PATENT DOCUMENTS

| | | | | |
|---|---|---|---|---|
| D423,742 | S | | 4/2000 | Kingry et al. |
| 6,052,860 | A | | 4/2000 | Coxsey |
| 6,088,868 | A | | 7/2000 | Cerveny |
| 6,128,800 | A | * | 10/2000 | Vosbikian ..... 15/172 |
| 6,223,386 | B1 | | 5/2001 | Morad |
| 6,240,594 | B1 | | 6/2001 | Demai et al. |
| 6,305,046 | B1 | | 10/2001 | Kingry et al. |
| 6,380,151 | B1 | | 4/2002 | Masters et al. |
| D461,610 | S | | 8/2002 | Perelli |
| 6,484,346 | B2 | | 11/2002 | Kingry et al. |
| D468,106 | S | | 1/2003 | Robertson |
| 6,513,184 | B1 | | 2/2003 | Brown et al. |
| 6,581,776 | B2 | * | 6/2003 | Zatkoff ..... 206/576 |
| 2002/0026680 | A1 | | 3/2002 | Kingry et al. |
| 2002/0042962 | A1 | | 4/2002 | Willman et al. |
| 2002/0050016 | A1 | | 5/2002 | Willman et al. |
| 2002/0184726 | A1 | | 12/2002 | Kingry et al. |

* cited by examiner

BROOM AND DUSTPAN KIT

BACKGROUND OF THE INVENTION

The present invention relates generally to the field of cleaning devices used for the manual collection of debris on a floor and more particularly to the combination of a broom and a dustpan.

Dustpans are well-known and widely used in commerce to facilitate the collection of debris on a floor or like surface. A dustpan is conventionally in the form of a pan-shaped scoop which comprises a substantially flat bottom panel, a pair of spaced apart side panels which protrude orthogonally up from opposite sides of the bottom panel and a back panel which extends between the pair of side panels along the rear edge of the bottom panel. Together, the bottom panel, the back panel and the pair of side panels at least partially define a debris collection cavity therebetween.

In use, a broom is used to sweep debris present on a floor or like surface over the front edge of the bottom panel and into the cavity defined by the dustpan. Commonly, the front edge of the bottom panel tapers in narrowly to a sharpened edge to facilitate the loading of debris into the cavity of the dustpan. With debris disposed in the cavity of the dustpan, orientation of the bottom panel in such a manner so that the front edge of the bottom panel is equal to or above the horizontal plane causes the debris to remain collected in the cavity. Debris collected in the cavity is preferably discarded by positioning the front edge of the bottom panel over a debris collection device, such as a trash can, and then pivoting the dustpan so that the front edge of the bottom panel is disposed beneath the horizontal plane, thereby causing the debris to slide along the bottom panel and exit the cavity of the dustpan over the front edge of the bottom panel.

A hand-held dustpan is one type of dustpan which is well-known and widely used in commerce. A hand-held dustpan typically comprises a short handle which is fixedly mounted onto and protrudes rearwardly from the back panel of the pan-shaped scoop of a conventional dustpan, the short handle extending in substantially the same plane as the bottom panel of the scoop. In some instances, the handle is shaped in such a way as to be removably mountable on the handle of a broom.

Although well-known and widely used in commerce, hand-held dustpans of the type described above suffer from a notable drawback. Specifically, when handling a hand-held dustpan, a user is required to bend over significantly in order to position the front edge of bottom panel of the scoop against the flooring surface. As can be appreciated, a user may experience significant physical discomfort or injury as a result of having to bend over in this manner, which is highly undesirable.

Accordingly, stand-up dustpans (also commonly referred to as upright pans or control handle-operated dustpans) are well known in the art. Stand-up dustpans differ from hand-held dustpans in that, inter alia, stand-up dustpans can be operated with the user disposed in an upright position whereas hand-held dustpans, in most application, can only be operated with the user disposed in a bent-over position.

A stand-up dustpan typically comprises an elongated, one-piece handle that is pivotally coupled to the pan-shaped scoop in such a manner that the scoop is capable of pivoting relative to the handle between first and second positions. With the scoop oriented in its first position, the bottom panel is disposed substantially in parallel to the handle, the front edge of the bottom panel facing upward so as trap any debris collected within the cavity of the scoop. With the scoop oriented in its second position, the bottom panel is disposed substantially at a right angle relative to the handle, thereby disposing the scoop in the optimal position to sweep debris into its cavity.

It should be noted that conventional stand-up dustpans are typically constructed or weighted in such a manner that the scoop resiliently returns to its first position. In order to dispose the scoop in its second position, the user is required to downwardly urge the rear of the bottom panel against the flooring surface through manipulation of the handle, thereby pivoting the bottom panel into its near horizontal position.

A stand-up dustpan is commonly offered for sale in combination with a broom in order to provide a consumer with a complete unit for removing debris from a floor. Such a broom has a one-piece handle and is typically shorter than a full-length broom. Often a clip or like fastener is used to couple together the broom and the stand-up dustpan when they are not being used. Both the broom and the stand-up dustpan are sold in a fully-assembled state and with very limited packaging.

As can be appreciated, the shipping, storage and display for sale of the combination of a fully-assembled broom and a fully-assembled stand-up dustpan introduces a number of significant drawbacks.

As a first drawback, due to its relatively large size, the combination fully-assembled broom and fully-assembled stand-up dustpan is considerably expensive to ship.

As a second drawback, due to its relatively large size, the combination fully-assembled broom and fully-assembled stand-up dustpan requires a considerably large amount of storage space prior to sale.

As a third drawback, due to its relatively large size, the combination fully-assembled broom and fully-assembled stand-up dustpan requires a considerably large amount of shelf space at the point of display for sale (e.g., the shelf space of a retail store).

As a fourth drawback, due to its limited packaging, the combination fully-assembled broom and fully-assembled stand-up dustpan is inadequately protected during its shipping, storage and display for sale. As a consequence, each item is rendered susceptible to damage.

SUMMARY OF THE INVENTION

It is an object of the present invention to provide a new combination broom and stand-up dustpan.

It is another object of the present invention to provide a combination broom and stand-up dustpan which overcomes at least some of the shortcomings present in existing combinations of brooms and stand-up dustpans.

Therefore, according to one feature of the present invention, there is provided a combination broom and stand-up dustpan wherein the stand-up dustpan comprises a handle, said handle including a plurality of separate sections which are coupled together to form a substantially pole-shaped member.

According to another feature of the present invention, the broom of said combination broom and stand-up dustpan includes a plurality of separate sections which are coupled together to form a substantially pole-shaped member.

The present invention is also directed to a kit for use in constructing a combination broom and stand-up dustpan, said kit comprising a broom head, a plurality of broom handle sections, a dustpan base member, and a plurality of dustpan handle sections, all of the foregoing components being disposed in a shipping container.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
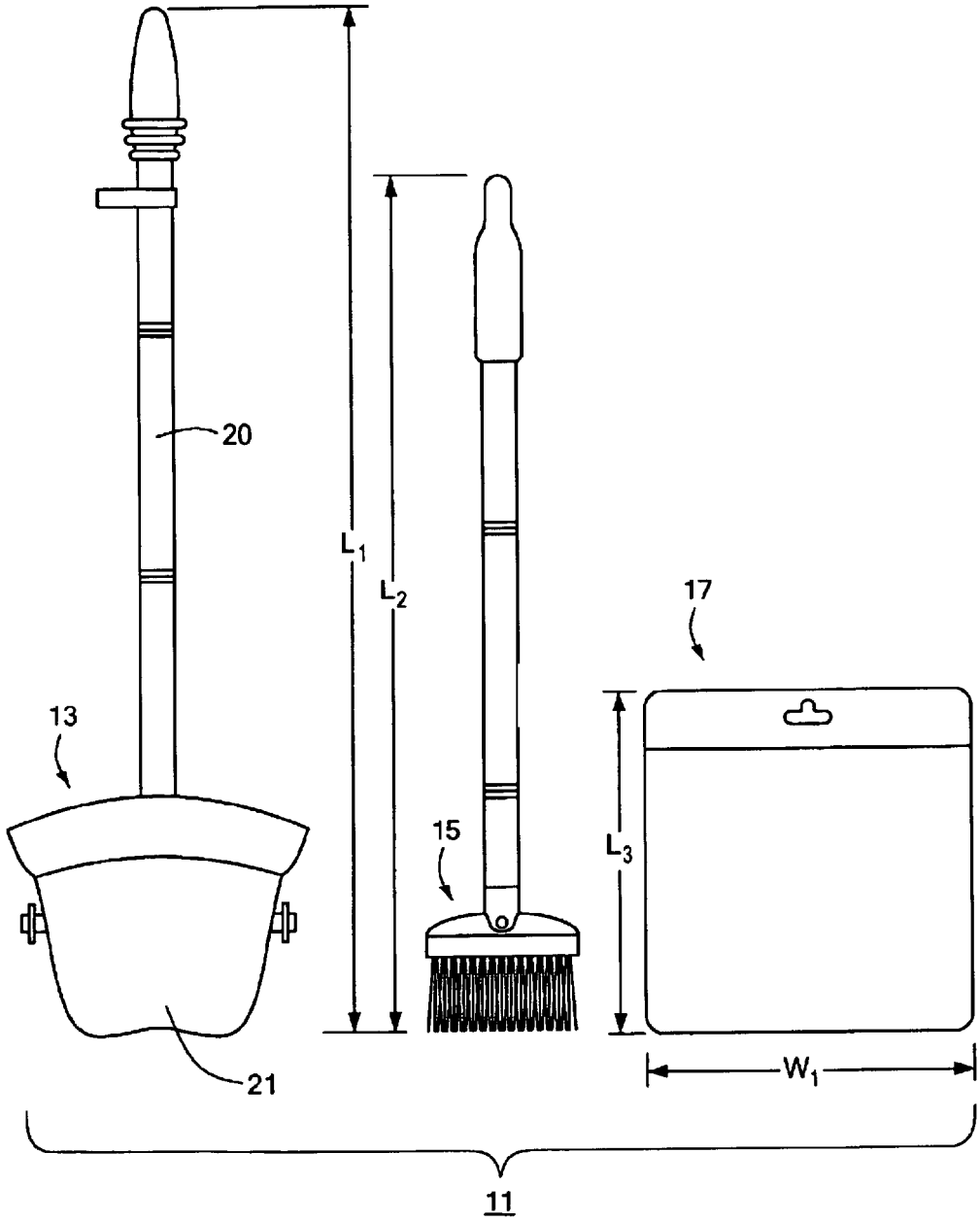
FIG. 1 is a front plan view of a broom, a stand-up dustpan, and a shipping container, all of which are constructed according to the teachings of the present invention.

Referring now to FIG. 1, there are shown a stand-up dustpan 13, a less than full-length broom 15, and a shipping container 17, all of which are constructed according to the teachings of the present invention, the three items being identified collectively by reference numeral 11.

As will be described below in further detail, dustpan 13 and broom 15 are designed so that both dustpan 13 and broom 15 may be disassembled and when in such a disassembled state may be disposed entirely within container 17 to form a kit. Such a kit is a highly compact and durable unit, thereby facilitating the transportation, storage and display for sale of dustpan 13 and broom 15, which is highly desirable.

Figure 2:
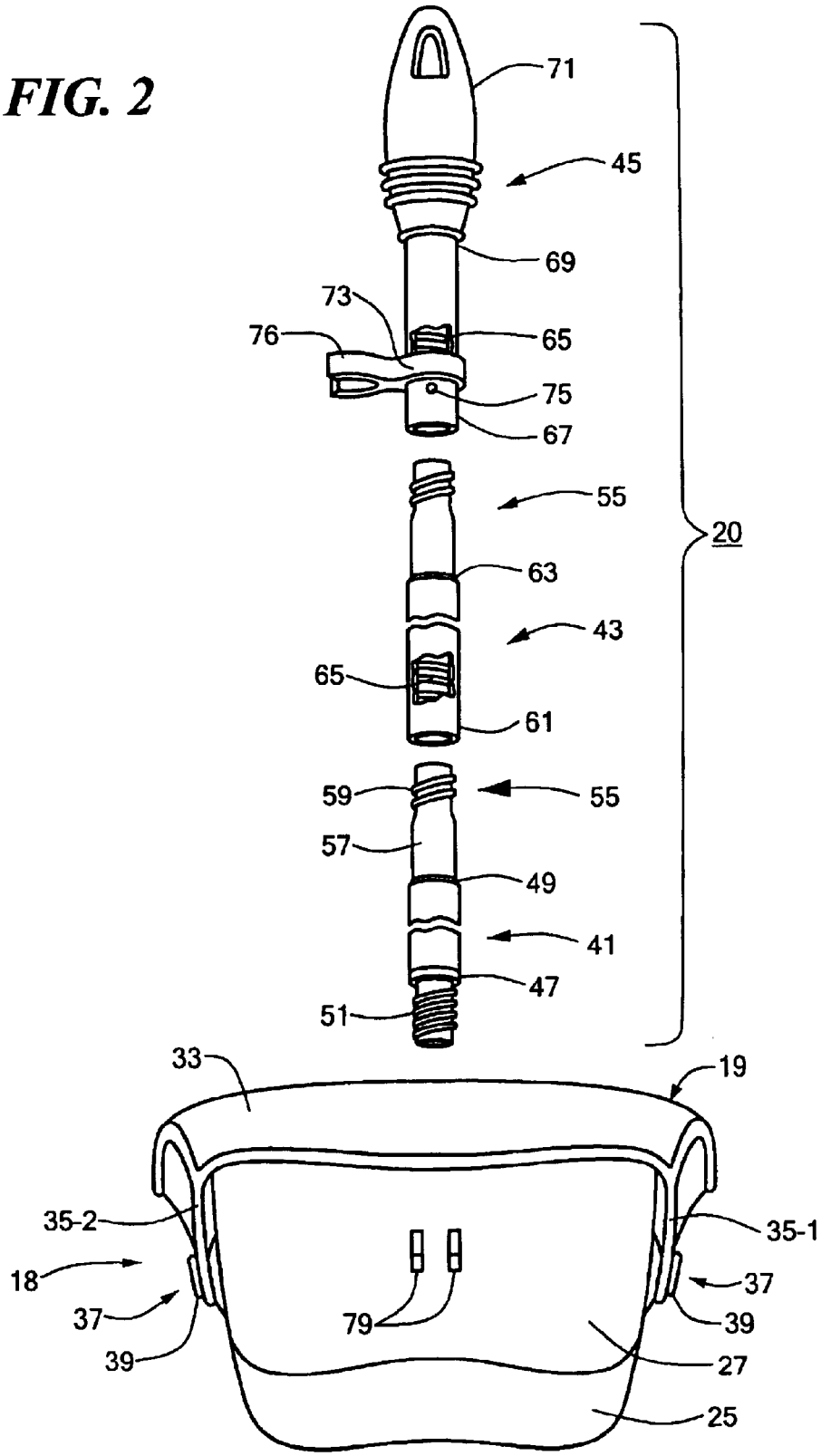
FIG. 2 is an exploded, fragmentary, rear perspective view, broken away in part, of the stand-up dustpan shown in FIG. 1.
Figure 3:
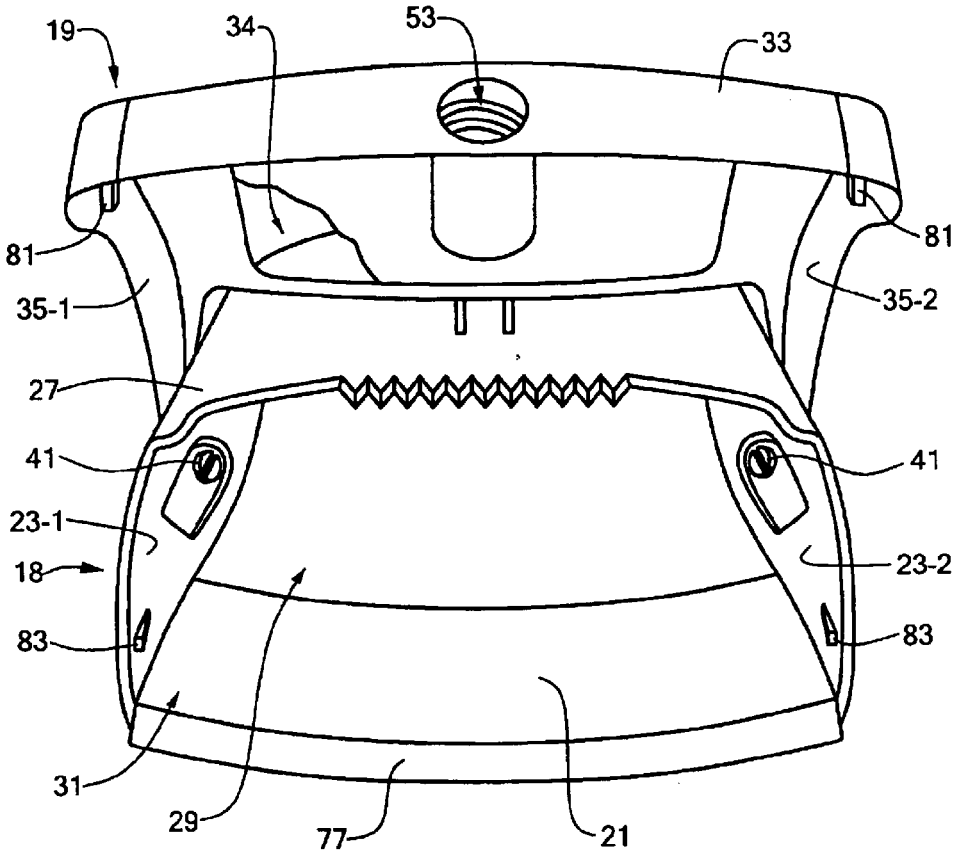
FIG. 3 is a front perspective view, broken away in part, of the base member and the cover of the dustpan shown in FIG. 1.

Stand-up dustpan 13 is designed principally for the collection of debris on a floor. As seen most clearly in FIGS. 2 and 3, stand-up dustpan 13 comprises a pan-shaped base member or scoop 18, a cover 19 pivotally coupled to base member 18, and a multi-section handle 20 releasably coupled to cover 19.

Base member 18 is constructed from a rigid and durable material, such as molded plastic, and includes a substantially flat bottom panel 21, a pair of spaced apart side panels 23-1 and 23-2 which protrude orthogonally up from opposite sides of bottom panel 21, a back panel 25 which extends between side panels 23-1 and 23-2 along the rear edge of bottom panel 21, and a top panel 27 which extends laterally across the top of side panels 23-1 and 23-2 in a spaced-apart, substantially parallel relationship with bottom panel 21. Together, bottom panel 21, side panels 23, back panel 25 and top panel 27 define an interior cavity 29, interior cavity 29 being accessible through an open front end 31.

Cover 19 is similarly constructed from a rigid and durable material, such as molded plastic, and is shaped to include an arcuate member 33 which is sized and shaped to selectively enclose open front end 31. A pair of flat, support arms 35-1 and 35-2 are integrally formed onto opposite sides of the rear edge of arcuate member 33. Support arms 35-1 and 35-2 are pivotally mounted onto the outer surface of side panels 23-1 and 23-2, respectively, in such a manner as to enable cover 19 to pivot freely relative to base member 18. A slot 34 is provided in member 33 to receive the head of broom 15 for storing the combination of dustpan 13 and broom 15 in a fully assembled state. Although not shown, the bottom of slot 34 is provided with a plurality of openings that open into cavity 29 of base member 18 so that when the head of broom 15 is disposed within slot 34, debris that has remained on the head of broom 15 may pass into cavity 29 of base member 18.

A fastener 37 serves to pivotally secure each support arm 35 onto its associated side panel 23. Fastener 37 comprises an enlarged button-shaped cap 39 which is sized and shaped to abut against the outer surface of its associated support arm 35. Fastener 37 additionally comprises an elongated shaft 41 which extends orthogonally out from cap 39, shaft 41 extending through its associated support arm 35 and through its associated side panel 23. The free end of shaft 41 is preferably in the form of an enlarged, slotted head which is sized and shaped to engage the inner surface of its associated side panel 23, thereby pivotally securing each support arm 35 onto its associated side panel 23.

It should be noted that the fact that fasteners 37 engage the inner surfaces of side panels 23, rather than the outer surfaces of side panels 23, serves to strengthen the connection between cover 19 and base member 18, thereby rendering dustpan 15 more durable and reliable, which is highly desirable.

Multi-section handle 20 includes a plurality of separate pieces which can be joined together to form a substantially pole-shaped member having a length of approximately 83.6 cm. Specifically, multi-section handle 20 comprises a first section 41 which is removably joined to cover 19, a second section 43 which is removably joined to first section 41, and a third section 45 which is removably joined to second section 43. (Although one may disassemble the various sections of handle 20 once they have been joined to one another, handle 20 is intended to remain in its assembled state after assembly.)

First section 41 is in the form of an elongated, hollow, cylindrical tube which is constructed of a strong, rigid and durable material, such as a piece of steel tubing which is approximately 2.2 cm in diameter and approximately 25.0 cm in length. First section 41 includes a first end 47 and a second end 49.

A male connector 51 which is threaded along its length is formed onto and extends orthogonally out from first end 47 of first section 41. Male connector 51 is sized and shaped to be fittingly inserted into and threadingly engage a threaded bore 53 which is integrally formed into arcuate member 33 of cover 19. In this manner, first section 41 of handle 20 can be coupled to cover 19 through the clockwise rotation of first section 41 about its longitudinal axis.

A unitary male connector 55 is formed onto and extends orthogonally out from second end 49 of first section 41. Male connector 55 comprises an elongated shaft 57 which extends out approximately 3.0 cm from second end 49 of first section 41. Male connector 55 additionally comprises a threaded shaft 59 which extends co-axially out from the free end of shaft 57 approximately 1.5 cm.

Second section 43 is in the form of an elongated, hollow, cylindrical tube which is constructed of a strong, rigid and durable material, such as a piece of steel tubing which is approximately 2.2 cm in diameter and approximately 25.0 cm in length. Second section 43 includes a first end 61 and a second end 63.

A female connector 65 is formed into second section 43 approximately 3.0 cm in from first end 61. Female connector 65 is in the form of internal threading formed along the inner surface of second section 43. It should be noted that female connector 65 is sized and shaped to fittingly receive and threadingly engage with male connector 55 on first section 41. In this manner, second section 43 of handle 20 can be coupled to first section 41 through the clockwise rotation of second section 43 about its longitudinal axis.

A unitary male connector 55 is formed onto and extends orthogonally out from second end 63 of second section 43.

Third section 45 is in the form of an elongated, hollow, cylindrical tube which is constructed of a strong, rigid and durable material, such as a piece of steel tubing which is approximately 2.2 cm in diameter. Third section 45 includes a first end 67 and a second end 69.

A female connector 65 is formed along the inner surface of third section 45 approximately 3.0 cm in from first end 67. It should be noted that female connector 65 is sized and shaped to fittingly receive and threadingly engage with male connector 55 on second section 43. In this manner, third section 45 of handle 20 can be coupled to second section 43 through the clockwise rotation of third section 45 about its longitudinal axis.

An ergonomic gripping device 71 is slidably disposed over second end 69 of third section 45, device 71 and third section 45 together having a length of approximately 30.0 cm. Furthermore, a coupling device 73 is slidably disposed over third section 45 between first end 67 and second end 69. A projection 75 is formed onto third section 45 proximate first end 67 to preclude coupling device 73 from sliding off of third section 45 over first end 67. Coupling device 73 is a unitary device constructed of a resilient and slightly flexible material, such as plastic, and is shaped to include a generally C-shaped clip 76. As can be appreciated, clip 76 is sized and shaped to releasably retain the handle of broom 15. In this manner, device 73 serves to couple together dustpan 13 and broom 15, which is highly desirable.

It should be noted that the multi-section construction of handle 20 renders handle 20 strong and rigid, which is highly desirable. Specifically, because the various sections of handle 20 are connected together at a plurality of different locations, handle 20 is able to more evenly distribute stress along its length, which is highly desirable. In addition, because the length of each male connector 55 (and in particular shaft 57) is considerably long, the stress experienced at the juncture between coupled sections is displaced over a greater length, which is highly desirable.

After having been fully-assembled, dustpan 13 is constructed for use in collecting debris by an operator standing in an upright position in the following manner. Due to the center of gravity of base member 18 and in the absence of an outside force onto dustpan 13, dustpan 13 is predisposed to orientate in its closed position (i.e., with cover 19 enclosing open front end 31 of base member 18). With dustpan 13 disposed in its closed position, bottom panel 21 of base member 18 is disposed substantially in parallel with the longitudinal axis of handle 20, with front edge of bottom panel 21 facing upward, as shown in FIG. 1.

In order to dispose dustpan 13 in its open position (i.e., in its position for collecting debris), the user is required to grasp device 71 and downwardly urge the rear of bottom panel 21 against the desired flooring surface. The downward force, in turn, pivots base member 18 in such a manner so that bottom panel 21 is disposed substantially at a right angle relative to handle 20 and substantially parallel with the surface of the floor. It should be noted that an elongated, thin rubber strip 77 is preferably mounted onto the front edge of bottom panel 21 in order to improve the seal of contact between bottom panel 21 and the floor in need of cleaning.

After having swept debris through open front end 31 and into cavity 29, the user lifts base member 18 of dustpan 13 off of the floor. As can be appreciated, the absence of a downward force onto base member 18 causes dustpan 13 to return to its closed position, thereby trapping the collected debris within cavity 29, which is highly desirable.

It should be noted that dustpan 13 is constructed to selectively lock in its open and closed positions.

In order to lock dustpan 13 in its open position, cover 19 is pivoted rearward (i.e., open) relative to base member 18 until the rear edge of member 33 is disposed behind and in engagement with a pair of tapered ribs 79 which are integrally formed onto the outer surface of top panel 27. As can be appreciated, dustpan 13 remains in its locked open position until a significant forward force is applied to cover 19.

In order to lock dustpan 13 in its closed position, cover 19 is pivoted forward (i.e., closed) relative to base member 18 until a pair of projections 81 which are integrally formed onto opposite sides of the inner surface of member 33 are disposed beneath and in engagement with a pair of ribs 83 formed onto the inner surface of side panels 23. As can be appreciated, dustpan 13 remains in its locked closed position until a significant rearward force is applied to cover 19.

Figure 4:
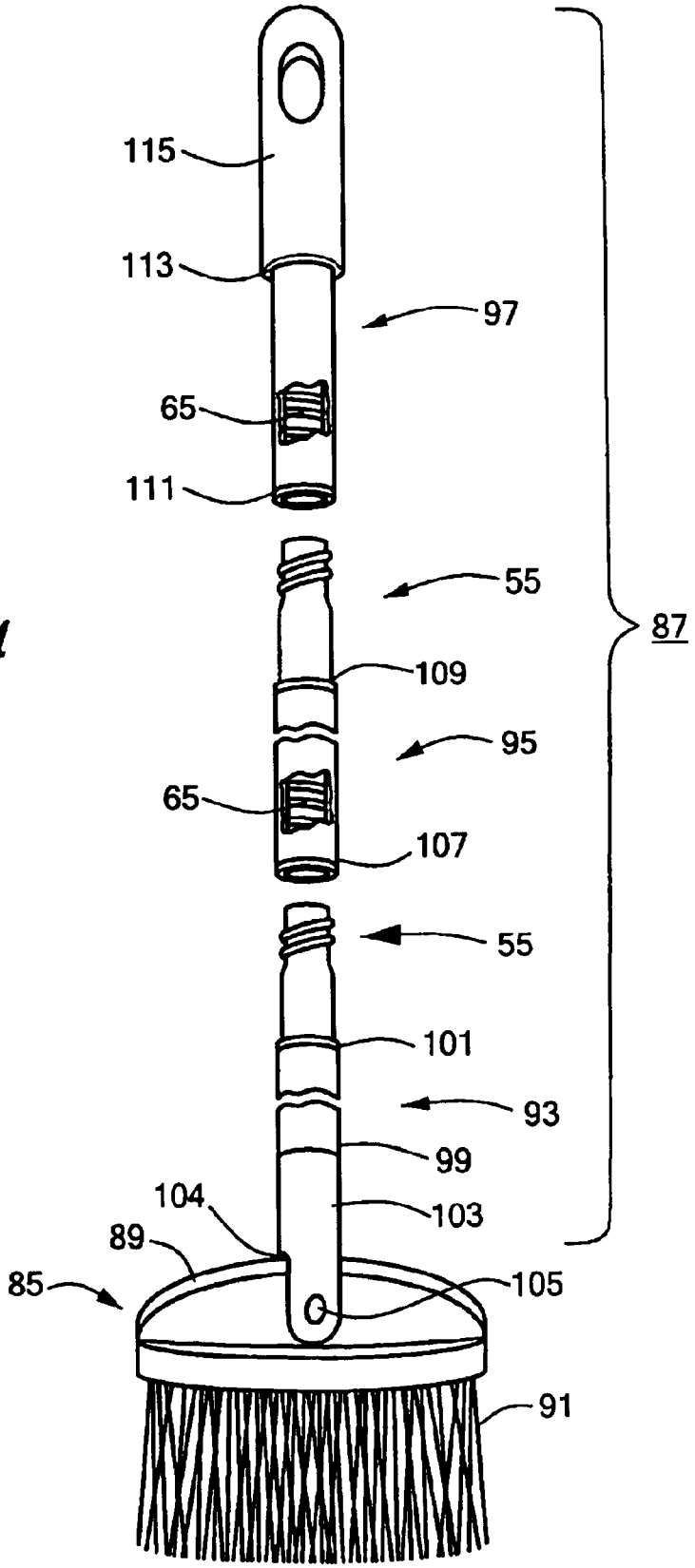
FIG. 4 is an exploded, fragmentary, front perspective view, broken away in part, of the broom shown in FIG. 1.

Broom 15 is designed principally for use in sweeping debris into stand-up dustpan 13. As seen most clearly in FIG. 4, broom 15 comprises a broom head 85 and a multi-section handle 87.

Broom head 85 comprises a rigid, plastic base 89 which is shaped to define a plurality of holes (not shown) which are circular in lateral cross-section. Broom head 85 further includes a plurality of tufts of filaments, or bristles, 91. Each tuft of bristles 91 is sized and shaped to fittingly protrude into an associated hole formed in base 89. Each hole in head 85 may be filled with an adhesive to secure its associated tuft of bristles 91 therewith in.

It should be noted that broom 15 is not limited to the particular construction of broom head 85. Rather, it is to be understood that broom head 85 could be replaced with alternative types of conventional broom heads without departing from the spirit of the present invention.

Multi-section handle 87 includes a plurality of separate pieces which can be joined together to form a substantially pole-shaped member having a length of approximately 77.4 cm. Specifically, multi-section handle 87 comprises a first section 93 which is pivotally coupled to broom head 85, a second section 95 which is removably joined to first section 93, and a third section 97 which is removably joined to second section 95. (Although one may disassemble the various sections of handle 87 once they have been joined to one another, handle 87 is intended to remain in its assembled state after assembly.)

First section 93 is in the form of an elongated, hollow, cylindrical tube which is constructed of a strong, rigid and durable material, such as a piece of steel tubing which is approximately 2.2 cm in diameter and approximately 16.5 cm in length. First section 93 includes a first end 99 and a second end 101.

A bifurcated member 103 is formed onto and extends orthogonally out from first end 99 of first section 93. A portion of base 89 is sized and shaped to fittingly protrude within the slot 104 defined by bifurcated member 103. Further, a pin 105 is disposed through bifurcated member 103 and base 89. In this capacity, broom head 85 is fixedly secured to first section 93, with broom head 85 capable of pivotal displacement relative to first section 93 about pin 105.

A unitary male connector 55 is formed onto and extends orthogonally out from second end 101 of first section 93.

Second section 95 is in the form of an elongated, hollow, cylindrical tube which is constructed of a strong, rigid and durable material, such as a piece of steel tubing which is approximately 2.2 cm in diameter and approximately 25.0 cm in length. Second section 95 includes a first end 107 and a second end 109.

A female connector 65 is formed along the inner surface of second section 95 approximately 3.0 cm in from first end 107. It should be noted that female connector 65 is sized and shaped to fittingly receive and threadingly engage with male connector 55 on first section 93. In this manner, second section 95 of handle 87 can be coupled to first section 93 through the clockwise rotation of second section 95 about its longitudinal axis.

A unitary male connector 55 is formed onto and extends orthogonally out from second end 109 of second section 95.

Third section 97 is in the form of an elongated, hollow, cylindrical tube which is constructed of a strong, rigid and durable material, such as a piece of steel tubing which is approximately 2.2 cm in diameter. Third section 97 includes a first end 111 and a second end 113.

A female connector 65 is formed into third section 97 approximately 3.0 cm in from first end 111. It should be noted that female connector 65 is sized and shaped to fittingly receive and threadingly engage with male connector 55 on first section 95. In this manner, third section 97 of handle 87 can be coupled to second section 95 through the clockwise rotation of third section 97 about its longitudinal axis.

A gripping device 115 is slidably disposed over second end 113 of third section 97, gripping device 115 providing an operator which a desirable surface for handling broom 15. Affixed together, gripping device 115 and third section 97 have an overall length of approximately 40.0 cm.

With broom 15 arranged in its assembled form, an operator can use broom 15 to sweep debris in the following manner. Specifically, grasping device 115 with one hand, the operator disposes broom 15 in such a manner so that bristles 91 contact the desired flooring surface. The operator then manipulates broom 15 so that bristles 91 collect and sweep debris off of the surface of the floor. Preferably, broom 15 displaces debris present on a floor into dustpan 13. The debris collected within dustpan 13 can then be discarded from dustpan 13 if desired. As a result, dustpan 13 and broom 15 together enable an operator to clean the surface of a floor without requiring the operator to bend over in an uncomfortable position, which is highly desirable.

Figure 5:
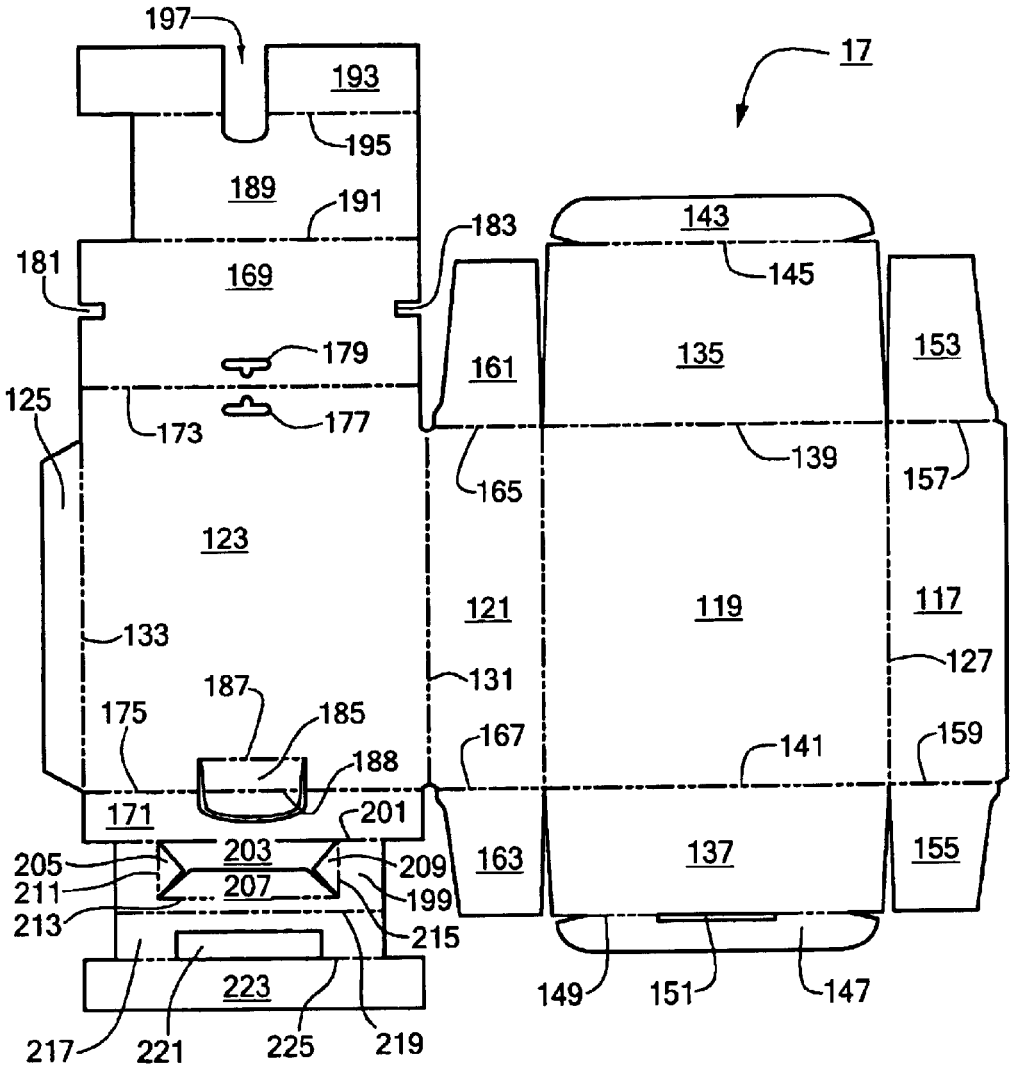
FIG. 5 is a front plan view of the inner surface of a blank used to form the container shown in FIG. 1.

Container 17 is designed primarily for the packaging of dustpan 13 and broom 15 into a compact and durable unit. Referring now to FIG. 5, there is shown a front plan view of the inner surface of a single-piece corrugated paperboard blank from which the preferred embodiment container 17 is formed. As will be described in detail below, through a series of steps, the blank shown in FIG. 5 can be formed into container 17 for shipping, storing and/or displaying dustpan 13 and broom 15. It should be noted that container 17, whether in its initial blank form or in its fully-assembled form, is represented herein as reference numeral 17.

Blank 17 comprises a left side panel 117, a front panel 119, a right side panel 121, a rear panel 123 and a glue flap 125. Left side panel 117 is generally rectangular in shape and is hingedly connected to front panel 119 by a scoreline 127. Front panel 119 is generally rectangular in shape and is hingedly connected to right side panel 121 by a scoreline 129. Right side panel 121 is identical in size and shape to left side panel 117 and is connected to rear panel 123 by a scoreline 131. Rear panel 123 is generally rectangular in shape (having a length which is slightly greater than the length of front panel 119 and a width which is equal to the width of front panel 119) and is connected to glue flap 125 by a scoreline 133. As will be hereinafter explained in detail, scorelines 127, 129, 131 and 133 are disposed in parallel relationship relative to each other to enable blank 17 to be formed into the container of the present invention, with glue flap 125 serving to secure the shape of the container.

Front panel 119 has a generally rectangular top panel 135 and a generally rectangular bottom panel 137 hingedly connected thereto by scorelines 139 and 141, respectively. Top panel 135 has a locking flap 143 hingedly connected thereto by a scoreline 145. Bottom panel 137 has a bottom flap 147 hingedly connected thereto by a scoreline 149, wherein an elongated slot 151 is formed co-linearly and along a portion of the length of scoreline 149.

Left side panel 117 has a top flap 153 and a bottom flap 155 connected thereto by scorelines 157 and 159, respectively. Similarly, right side panel 121 has a top flap 161 and a bottom flap 163 connected thereto by scorelines 165 and 167, respectively.

Rear panel 123 has a rear support panel 169 and a rear support flap 171 connected thereto by scorelines 173 and 175, respectively. A pair of complementary holes 177 and 179 are formed in rear panel 123 and rear support panel 169, respectively. Holes 177 and 179 are orientated to align as rear support panel 169 is folded about scoreline 173. In addition, a pair of opposing rectangular notches 181 and 183 are formed into opposite sides of rear support panel 169, notches 181 and 183 serving to help retain container 17 in its assembled form. Furthermore, a three-sided tab 185 is formed into rear panel 123 and rear support flap 171, tab 185 being connected rear panel 123 by a scoreline 187 and including therewithin a lateral scoreline 188.

A partition, or shelf 189 is connected to rear support panel 169 by a scoreline 191. It should be noted that the width of partition 189 is significantly less than the width of front panel 119 and rear panel 123. As will be described further in detail below, partition 189 serves as a horizontal shelf for subdividing the interior cavity of container 17 when configured for shipping, storage and display for sale.

A front support panel 193 is connected to partition 189 by a scoreline 195, the width of front support panel 193 being equal to the width of rear panel 123. An elongated slot 197 is formed into the free end of front support panel 193 and extends into partition 189.

A dustpan support panel 199 is connected to rear support flap 171 by a scoreline 201. Dustpan support panel 199 is shaped to define a slot 203 which is bounded on three sides by flaps 205, 207 and 209 which, in turn, can be folded about scorelines 211, 213 and 215, respectively. It should be noted that dustpan support panel 199 has a width which is less than the width of rear panel 123.

A broom support panel 217 is connected to dustpan support panel 199 by a scoreline 219. Broom support panel 217 is shaped to define a generally rectangular slot 221. It should be noted that broom support panel 217 has a width which is less than the width of rear panel 123.

A front support flap 223 is connected to broom support panel 217 by a scoreline 225. Front support flap has a width which is equal to the width of rear panel 123.

Blank 17 can be formed into the container of the present invention for the shipping, storage and display for sale of both dustpan 13 and broom 15 in the following manner. Left side panel 117 and right side panel 121 are folded upward through scorelines 127 and 129, respectively, so as to extend perpendicularly relative to front panel 119. Glue flap 125 is folded up through scoreline 133 so as to extend perpendicularly relative to rear panel 123 and rear panel 123 is folded up through scoreline 131 so as to extend perpendicularly relative to right side panel 121, with glue flap 125 disposed in direct contact against the inner face of left side panel 117 to form the four-sided (i.e., front, rear, left side and right side) configuration of container 17. A portion of the outer surface of glue flap 125 has an adhesive, such as glue, applied thereto which contacts the inner face of left side panel 117 to secure in place the four-sided structure of container 17.

To close the bottom of container 17, rear support flap 171 is folded inward about scoreline 175 until the inner face of rear support flap 171 is drawn in contact against the inner surface of rear panel 123. Similarly, front support flap 223 is folded up about scoreline 225 until the inner face of front support flap 223 is drawn in contact against the inner surface of front panel 119. Bottom flaps 155 and 163 are then folded closed through scorelines 159 and 167, respectively. Thereafter, bottom panel 137 is folded closed through scoreline 141 so as to enclose the bottom of container 17. Preferably, tab 185 is folded inward about scorelines 187 and 188 in such a manner so as to penetrate through slot 151, thereby securing the bottom of container 17 closed.

It should be noted that with the bottom of container 17 closed in this manner, an interior cavity 227 is created in which broom 15 and dustpan 13 can be disposed. In addition, with the bottom of container 17 closed, dustpan support panel 199 and broom support panel 217 are disposed slightly above and substantially in parallel with bottom panel 137.

Broom head 85 and first section 93 of broom 15 is preferably disposed vertically into interior cavity 227 against the inner face of front panel 119 in such a manner that bristles 91 fittingly protrude into slot 221. As can be appreciated, the fitted relationship of bristles 91 within slot 221 serves to stabilize broom head 85 and first section 93 of broom 15 within container 17, which is highly desirable.

In addition, scoop 18 and cover 19 (with cover 19 disposed in its closed position) is preferably disposed vertically into interior cavity 227 against the inner face of rear panel 123 such that back panel 25 fittingly protrudes into slot 203. As can be appreciated, movable flaps 205, 207 and 209 serve to tightly secure back panel 25 of scoop 18 into slot 203. As can be appreciated, the fitting relationship of back panel 25 of scoop 18 within slot 203 serves to tightly secure scoop 18 and cover 19 within container 17, which is highly desirable.

Furthermore, with the bottom of container 17 closed, and with broom head 85, first section 93, scoop 18, and cover 19 disposed within interior cavity 227 in the manner noted above, first section 41, second section 43 and third section 45 of handle 20 are preferably vertically disposed into interior cavity 227 against the inner face of left side panel 117, sections 41, 43 and 45 being disposed in a front-to-back linear configuration.

Figure 6:
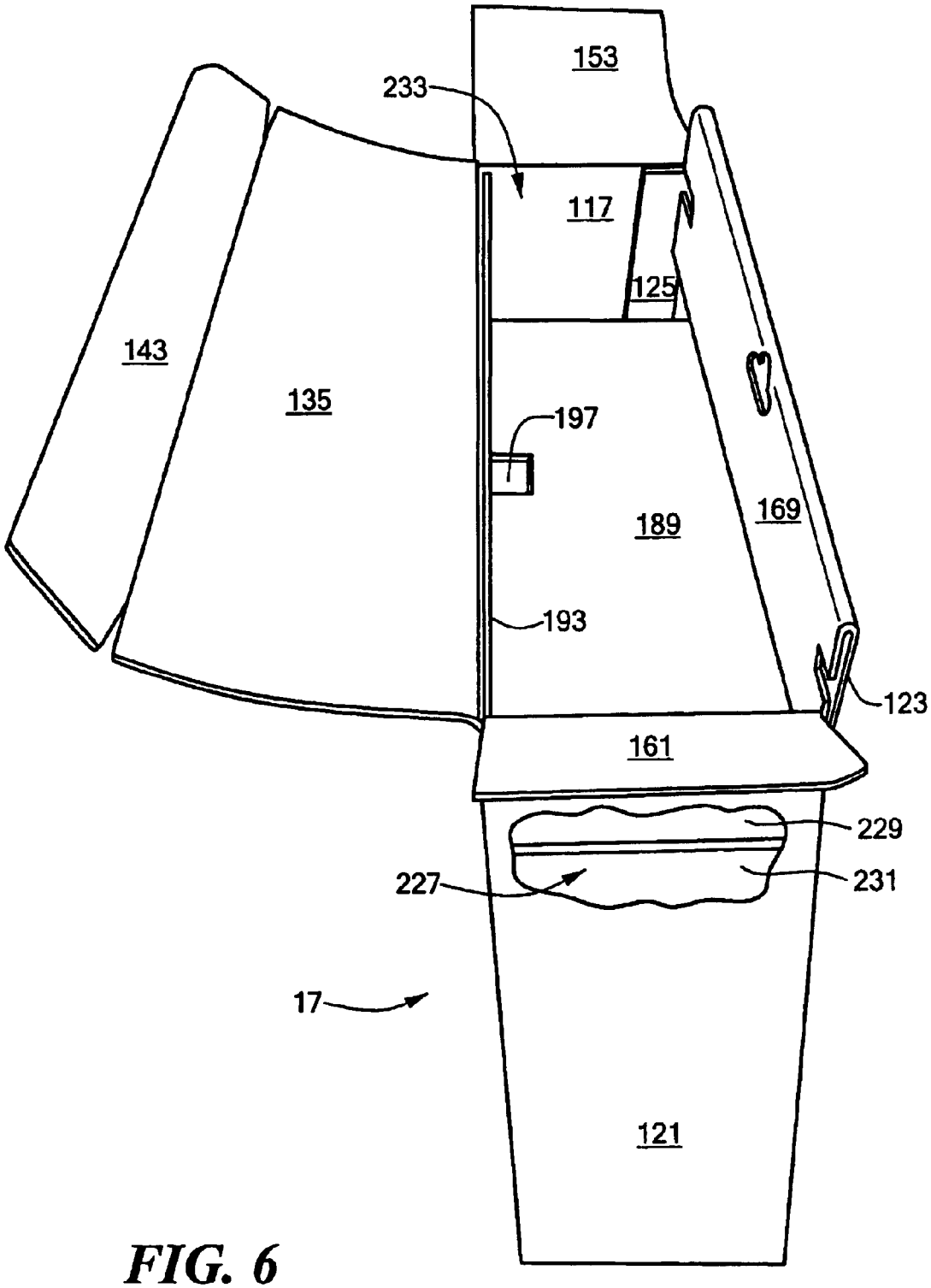
FIG. 6 is a top, right side, perspective view, broken away in part, of the container shown in FIG. 1, the container being shown with its top panel disposed in the open position.
Figure 7:
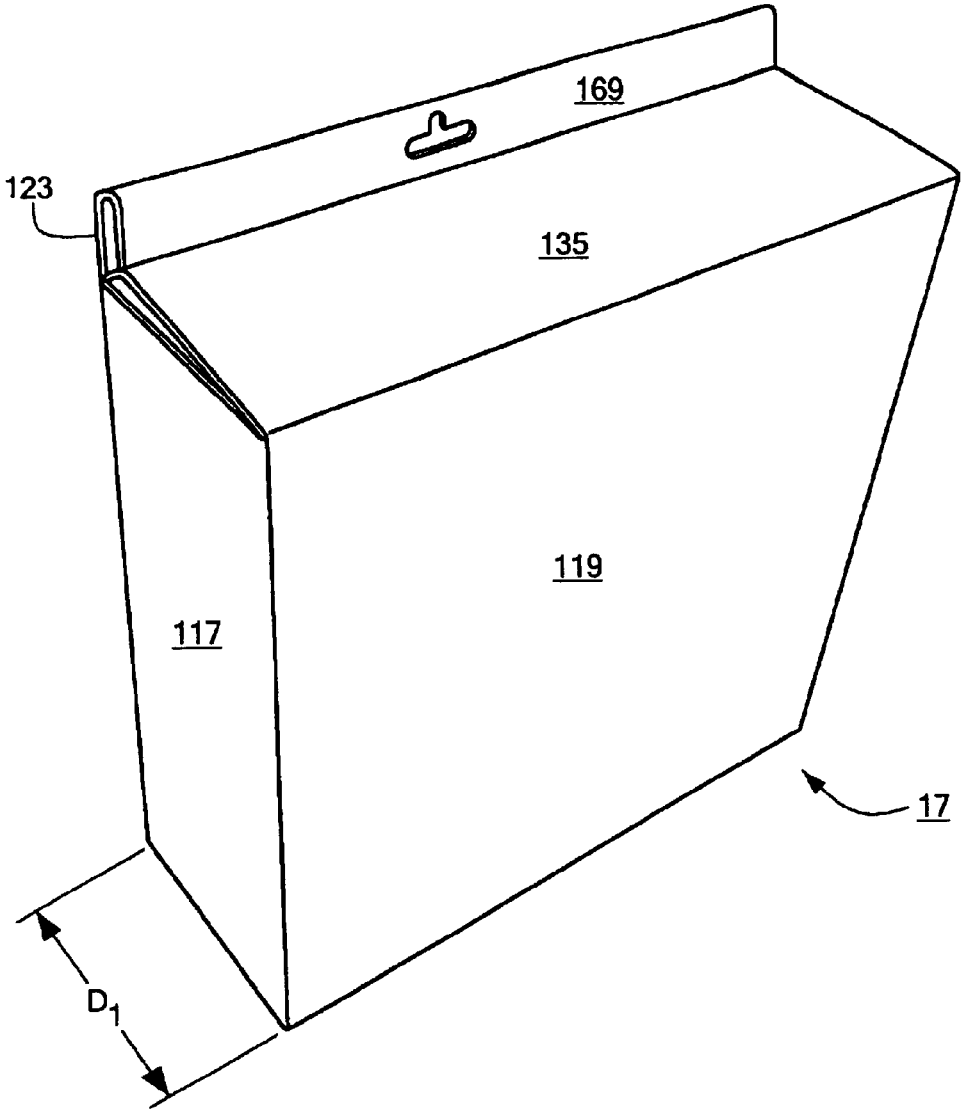
FIG. 7 is a front, left side, top perspective view of the container shown in FIG. 1, the container being shown in its configuration for shipping, storage and/or display.

With all of the pieces of dustpan 20 and with broom head 85 and first piece 93 of broom 15 disposed within interior cavity 227 of the partially enclosed container 17 as described above, partition 189 can be orientated so as to subdivide interior cavity 227. Specifically, rear support panel 169 is folded inward through scoreline 173 so that the inner face of rear support panel 169 abuts against the inner face of rear panel 123 (with openings 177 and 179 in alignment with one another). Partition 189 is then folded upward through scoreline 191 in such a manner so that partition 189 extends forward at a right angle relative to rear support panel 169. Thereafter, front support panel 193 is folded upward through scoreline 195 in such a manner so that inner face of front support panel 193 abuts against the inner face of front panel 119, as shown in FIG. 6.

It should be noted that, with blank 17 configured as such, partition 189 serves to at least partially subdivide interior cavity 227 into an upper chamber 229 and a lower chamber 231. In addition, the reduced width of partition 189 in relation to front and rear panels 119 and 123 serves to create a generally rectangular opening 233 in partition 189 between upper chamber 229 and lower chamber 231. Opening 233 is sized, shaped and positioned so that first section 41, second section 43 and third section 45 of handle 20 can penetrate therethough, thereby enabling sections 41, 43 and 45 to extend nearly the entire length of interior cavity 227 along left side panel 117. Furthermore, slot 197 formed into partition 189 serves to create a rectangular opening through which first end 101 of first section 93 of broom 15 can penetrate, thereby enabling broom head 85 and first section 93 to extend nearly the entire length of interior cavity 227 along front panel 119.

Having disposed partition 189 in the manner described above, second section 95 and third section 97 of broom 15 can be disposed horizontally on partition 189 within upper chamber 229. In this manner, all of the various sections of both dustpan 13 and broom 15 are positioned within interior cavity 227 of container 17, which is highly desirable. With dustpan 13 and broom 15 disposed within interior cavity 227 of container 17 in the manner described above, the open top of container 17 can be closed in the following manner so as to enclose interior cavity 227. Specifically, top flaps 153 and 161 are folded inward about scorelines 157 and 165, respectively. Thereafter, top panel 135 is folded down through scoreline 139 and into a horizontal position, top panel 135 being sized and shaped to enclose the open top of interior cavity 227. In order to secure top panel 135 in its closed position, locking flap 143 is folded about scoreline 145 so that the outer face of locking flap 143 contacts the outer face of rear support panel 169. Locking flap 143 is sized and shaped to fittingly project into upper chamber 229, the opposing sides of locking flap 143 engaging notches 181 and 183 formed in rear support panel 169 so as to lock top panel 135 in its closed position.

As can be appreciated, the particular construction of the present kit allows for the packaging of a considerably large upright dustpan 13 and a considerably large, but less than full-size, broom 15 into relatively small container 17 in such a manner so as to create a compact and durable unit. Specifically, the particular construction of the present kit allows for an upright dustpan 13 having a fully-assembled length $L_1$ of approximately 107.5 cm and a broom 15 having a fully-assembled length $L_2$ of 84.8 cm to fit within a container 17 having an overall length $L_3$ which is approximately 36.8 cm, an overall width $W_1$ which is approximately 32.6 cm, and a depth $D_1$ which is approximately 10.9 cm, which is highly desirable.

The embodiment shown of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A kit comprising:

(a) a dustpan base member;

(b) a plurality of unconnected handle sections made of cylindrical tubing all having the same diameter and adapted to be joined together in axial alignment to form a dustpan handle, said dustpan handle being adapted to be coupled to said dustpan base member; and (c) a container, said container being shaped to define an interior cavity, said interior cavity being dimensioned to contain said dustpan base member and said unconnected handle sections prior to assembly.

2. The kit of claim 1 wherein said dustpan handle comprises a first section having a first end and a second end, and a second section having a first end and a second end, the first end of the second section being coupled to the second end of the first section.

3. The kit of claim 2 wherein said dustpan handle further comprises a third section, said third section having a first end and a second end, the first end of the third section being coupled to the second end of the second section.

4. The kit of claim 2 wherein a first connector is integrally formed on the second end of the first section and a second connector is integrally formed on the first end of the second section, said second connector being adapted to engage the first connector.

5. The kit of claim 4 wherein one of said first connector and said second connector is in the form of a male connector which includes an elongated shaft and a threaded shaft formed onto one end of said elongated shaft.

6. The kit of claim 5 wherein said elongated shaft is approximately 3.0 cm in length and said threaded shaft is approximately 1.5 cm in length.

7. The kit of claim 3 wherein each of said first, second and third sections is in the form of a hollow, cylindrical tube which is constructed of steel and which has a diameter of approximately 2.2 cm.

8. The kit of claim 2 wherein the dustpan handle has an overall length of approximately 83.6 cm.

9. The kit of claim 1 further comprising a broom head and a plurality of separate broom handle sections made of cylindrical tubing having the same diameter, said broom head and said separate broom handle sections being disposed within said container, said separate broom handle sections being adapted to be joined together end-to-end to form a broom handle having a fixed length, said broom handle being adapted to be joined to said broom head.

10. The kit of claim 9 wherein said broom handle comprises (a) a first section, said first section having a first end and a second end, the first end of the first section being adapted to be coupled to said broom head, and (b) a second section, said second section having a first end and a second end, the first end of the second section being adapted to be coupled to the second end of the first section.

11. The kit of claim 10, wherein said broom handle further comprises a third section having a first end and a second end, the first end of the third section of the broom handle being adapted to be coupled to the second end of the second section of the broom handle.

12. The kit of claim 11 wherein the broom handle has an overall length of approximately 77.4 cm.

13. The kit of claim 10 wherein said container is formed from a single-piece corrugated paperboard blank.

14. The kit of claim 10 wherein said container has a length of approximately 36.8 cm, a width of approximately 32.6 cm, and a depth of approximately 10.9 cm.

15. A stand-up dustpan comprising:

(a) a dustpan base member;

(b) a cover pivotally coupled to said dustpan base member;

(c) a plurality of separate handle sections made of cylindrical tubing having the same diameter joined together end-to-end and in axial alignment to form a dustpan handle having a fixed length, said dustpan handle being joined to said cover.

16. The stand-up dustpan as claimed in claim 15 wherein said dustpan handle comprises three separate handle sections.

17. The stand-up dustpan as claimed in claim 16 wherein said dustpan handle is a generally pole-shaped member having a length of about 80–85 cm.

18. A kit comprising:

(a) a dustpan base member said base member comprises (i) a bottom panel, (ii) a pair of spaced apart side panels which protrude up from opposite sides of said bottom panel, (iii) a back panel which extends between said side panel along the rear edge of said bottom panel, and (iv) a top panel which extends laterally across the top of said pair of side panels in a spaced apart, substantially parallel relationship with said bottom panel, said bottom panel, said pair of side panels, said back panel and said top panel together at least partially defining an interior cavity for said base member, the interior cavity for said base member being accessible through an open front end, said kit further comprising a cover pivotally coupled to said based member, said cover being sized and shaped to selectively enclose the open front end thereof;

(b) a plurality of separate handle sections adapted to be joined together to form a dustpan handle, said dustpan handle being adapted to be coupled to said dustpan base member said dustpan handle comprising a first section having a first end and a second end, and a second section having a first end and a second end, the first end of the second section being coupled to the second end of the first section, and (c) a container, said container being shaped to define an interior cavity, said interior cavity being dimensioned to contain said dustpan base member and said separate handle sections.

19. The kit of claim 18 further comprising a pair of fasteners for pivotally coupling said cover to said base member.

20. The kit of claim 19 wherein each fastener is coupled to said cover and is adapted to engage the inner surface of a corresponding side panel of said base member.

21. A kit comprising:

(a) a dustpan base member;

(b) a plurality of separate handle sections adapted to be joined together to form a dustpan handle, said dustpan handle being adapted to be coupled to said dustpan base member;

(c) a container, said container bing shaped to define an interior cavity, said interior cavity being dimensioned to contain said dustpan base member and said separate handle sections, said container comprising a partition which at least partially subdivides the interior cavity defined by said container into an upper chamber and a lower chamber, (d) a broom head and a plurality of separate broom handle sections, said broom head and said separate broom handle sections being disposed within said container, said separate broom handle sections being adapted to be joined together to form a broom handle, said broom handle being adapted to be joined to said broom head, said broom handle comprising:

(i) a first section, said first section having a first end and a second end, the first end of the first section being adapted to be coupled to said broom head, and (ii) a second section, said second section having a first end and a second end, the first end of the second section being adapted to be coupled to the second end of the first section.

22. A kit comprising:

(a) a dustpan base member;

(b) a plurality of separate handle sections adapted to be joined together to form a dustpan handle, said dustpan handle being adapted to be coupled to said dustpan base member;

(c) a container, said container being shaped to define an interior cavity, said interior cavity being dimensioned to contain said dustpan base member and said separate handle sections, said container comprising a rear panel, a right side panel, a front panel, and a left side panel foldably connected together to form a box-shaped container having an open top and an open bottom, a bottom panel foldably connected to said front panel, said bottom panel being sized and shaped to close the open bottom when folded, a top panel foldably connected to said front panel, said top panel being sized and shaped to close the open top when folded, and a rear support panel foldably connected to said rear panel, a partition foldably connected to said rear support panels, and a front support panel foldably connected to said partition, said partition being sized and shaped to at least partially subdivide the interior cavity defined by said container when said rear support panel, said partition and said front support panel are folded, (d) a broom head and a plurality of separate broom handle sections, said broom head and said separate broom handle sections being disposed within said container, said separate broom handle sections being adapted to be joined together to form a broom handle, said broom handle being adapted to be joined to said broom head, said broom handle comprising:

(i) a first section, said first section having a first end and a second end, the first end of the first section being adapted to be coupled to said broom head, and (ii) a second section, said second section having a first end and a second end, the first end of the second section being adapted to be coupled to the second end of the first section.

23. The kit of claim 22 wherein said rear panel is wider than said partition.

24. The kit of claim 23 wherein an elongated slot is formed into said partition.

25. The kit of claim 24 said container further comprises a rear support flap foldably connected to said rear panel, a dustpan support panel foldably connected to said rear support flap, a broom support panel foldably connected to said dustpan support panel, and a front support flap foldably connected to said broom support panel.

26. The kit of claim 25 wherein said dustpan support panel is shaped to define a slot which is sized and shaped to receive a portion of said base member.

27. The kit of claim 26 wherein said broom support is shaped to define a slot which is sized and shaped to receive a portion of said broom head.

28. A kit comprising:

(a) a stand-up dustpan, said stand-up dustpan comprising:

(i) a dustpan base member, (ii) a cover pivotally coupled to said dustpan base member, and (iii) a dustpan handle adapted to be connected to said cover, said dustpan handle comprising a plurality of unconnected handle pieces which can be joined together in end-to-end relationship to form a substantially pole shaped member, (b) a broom comprising:

(i) a broom head;

(ii) a broom handle adapted to be connected to said broom head, said broom handle comprising a plurality of unconnected handle pieces which can be joined together in end-to-end relationship to form a substantially pole shaped member;

(c) a container for holding said stand-up dustpan and said broom in a disassembled state.

29. The kit of claim 28 wherein said plurality of unconnected dustpan handle sections are made of cylindrical tubing having the same diameter.

30. The kit of claim 29 wherein said plurality of unconnected broom handle sections are made of cylindrical tubing having the diameter.

31. The kit of claim 28 wherein said cover includes a threaded bore and said plurality of unconnected dustpan handle sections includes a first handle section having a threaded shaft for engaging the threaded bore in said cover.

32. The kit of claim 28 and further including a coupling device on the dustpan handle for releasably retaining the broom handle.

33. A kit comprising:

(a) a dustpan base member;

(b) a cover pivotally coupled to said dustpan base member;

(c) a plurality of unconnected handle sections made of cylindrical tubing having the same diameter and adapted to be joined together end-to-end to form a dustpan handle having a fixed length, said dustpan handle being adapted to be joined to said cover and (d) a container, said container being shaped to define an interior cavity, said interior cavity being dimensioned to contain said dustpan base member and said separate handle sections prior to assembly.

34. A dustpan and broom combination comprising:

(a) a dustpan, said dustpan comprising:

(i) a dustpan base member;

(ii) a cover pivotally coupled to said dustpan base member;

(iii) a dustpan handle joined to said cover, said dustpan handle comprising a plurality of handle sections made of cylindrical tubing having the same diameter joined together end-to-end and in axial alignment, (b) a broom, said broom comprising:

(i) a broom head;

(ii) a broom handle connected to said broom head, said broom handle comprising a plurality of handle sections made of cylindrical tubing having the same diameter joined together end-to-end and in axial alignment, (c) a coupling device for releasably attaching the dustpan to the broom, (iii) a dustpan handle joined to said cover, said dustpan handle comprising a plurality of handle sections made of cylindrical tubing having the same diameter joined together end-to-end and in axial alignment, (b) a broom, said broom comprising:

(i) a broom head;

(ii) a broom handle connected to said broom head, said broom handle comprising a plurality of handle sections made of cylindrical tubing having the same diameter joined together end-to-end and in axial alignment, (c) a coupling device for releasably attaching the dustpan to the broom.

* * * * *